United States Patent [19]

Michalchik

[11] 4,120,828

[45] Oct. 17, 1978

[54] PRESSURE SENSITIVE RESISTANCE AND PROCESS OF MAKING SAME

[75] Inventor: Michael Michalchik, Newport Beach, Calif.

[73] Assignee: Dynacon Industries, Inc., West Milford, N.J.

[21] Appl. No.: 824,298

[22] Filed: Aug. 15, 1977

[51] Int. Cl.[2] ..... H01B 1/02

[52] U.S. Cl. ..... 252/513; 252/512; 428/403

[58] Field of Search ..... 252/513, 512; 428/403

[56] References Cited

U.S. PATENT DOCUMENTS

| | | | |
|---|---|---|---|
| 3,629,774 | 12/1971 | Crites | 338/114 |
| 3,766,095 | 10/1973 | Mastrangelo | 252/513 |

*Primary Examiner*—Benjamin R. Padgett

*Assistant Examiner*—E. Suzanne Parr

*Attorney, Agent, or Firm*—Frank L. Durr; Orville N. Greene

[57] ABSTRACT

A pressure sensitive resistance material and process for making the same is described which is of the type comprising an elastomeric matrix with conducting metal particles dispersed therein. Improved performance and improved ranges of conductivity between the no pressure and pressure ranges are obtained by coating the metallic conducting particles with semi-conducting material and further improved results are obtained when the semi-conducting material comprises a reaction product of an organic metal compound with an aryl peroxide of similar aryl compound. The material may be made available as a coating material or as a shaped product.

7 Claims, 1 Drawing Figure

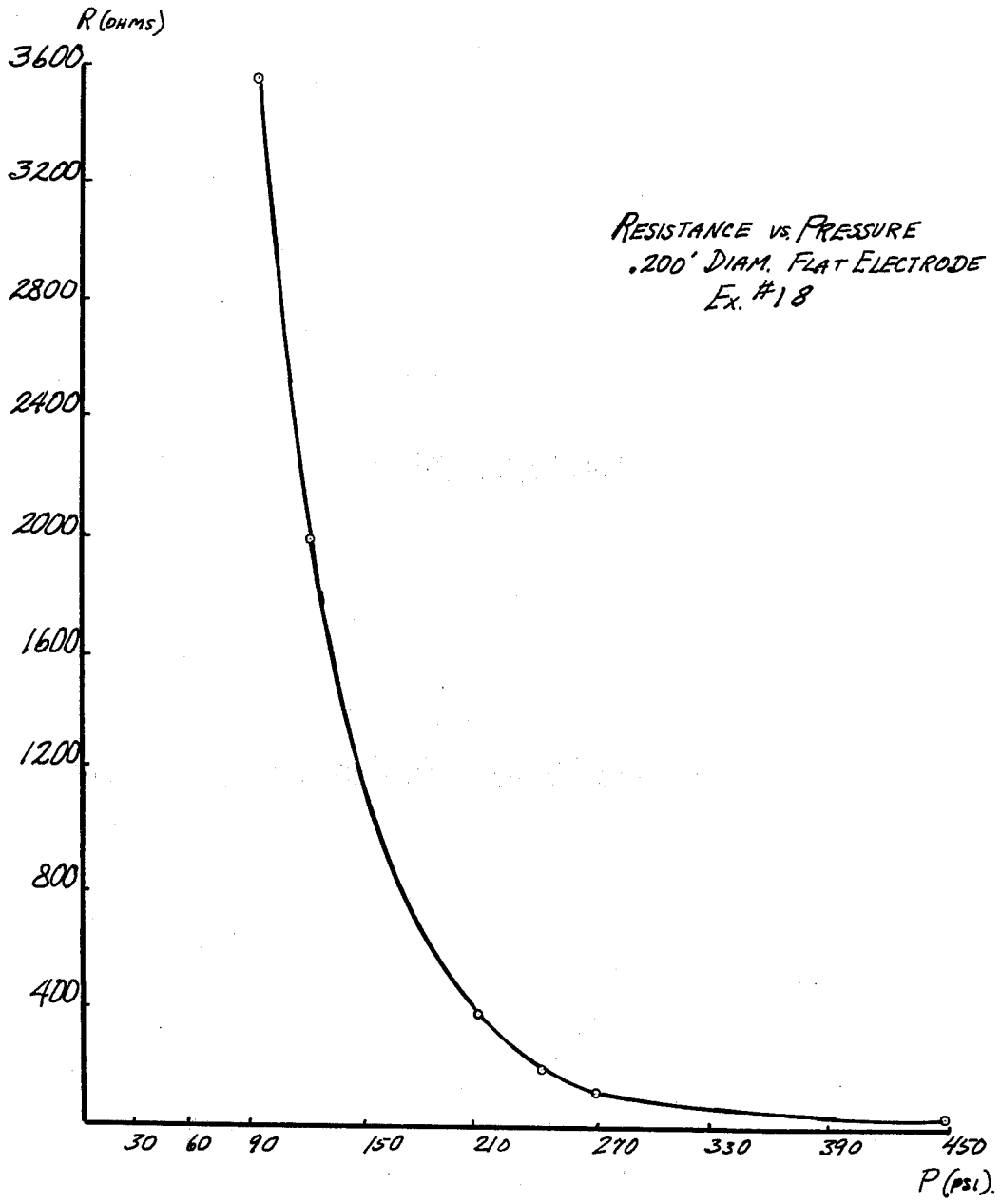
R (OHMS)
3600
3200
2800
2400
2000
1600
1200
800
400
30
60
90
150
210
270
330
390
450
P (psi).
RESISTANCE vs. PRESSURE
.200' DIAM. FLAT ELECTRODE
Ex. #18

PRESSURE SENSITIVE RESISTANCE AND PROCESS OF MAKING SAME

This is a division of application Ser. No. 575,184 filed May 7, 1975, now U.S. Pat. No. 4,054,540, which is a continuation - in - part of application Ser. No. 335,499, filed Feb. 26, 1973, now abandoned.

According to said prior application, improved pressure sensitive resistance material of the type containing metal conducting particles embedded in an elastomeric matrix, have been obtained when the metal particles are pretreated with a organic compound (which in some cases acts as an inhibitor of catalysis for the matrix material). Further improved results were obtained by prereacting the coated metal particles with an aryl type of peroxide. It has also been found that the reaction of organic metallic compounds with peroxides, especially aryl peroxides, can be prepared and then applied to the metal particles with the aid of a solvent. Also, additional semi-conducting compounds and additional matrix materials not disclosed in said original application, have been found to produce equivalent desired results. In addition, it has been found that the original range for the amount of the coating material was erroneously set forth in the prior disclosure.

This invention relates to pressure sensitive resistance elements and to process of producing the same. The pressure sensitive resistance material may also be in the form of a plastic composition and applied as a coating.

Pressure sensitive resistance devices are well-known. Generally, such devices comprise a matrix of insulating, elastomeric or yieldable material in which is dispersed, more or less uniformly, a multiplicity of relatively fine, electrically conducting powders. The following conducting particles have been suggested for embedding in a non-conducting matrix, although not always for a pressure sensitive product, iron, copper, chromium, titanium, tungsten, platinum, boron, stainless steel, silicon, silver, gold, nickel, cobalt, aluminum, zinc, "Nichrome," carbon (in the form of carbon black or graphite, for example), etc. The metals or carbon may be in the form of strands, flakes, spheres or irregularly shaped particles and the sizes of the metal particles, which have been specified as useful, may vary from about 0.003 microns up to about 100 mils (2500 microns) although it is generally agreed that smaller particles are preferred; also, with respect to carbon additions, some exceptionally finely divided carbon materials have been employed.

Among the objects of the present invention is to provide a pressure sensitive material or element of the type wherein small conducting metallic particles are embedded in a flexible or elastomeric base, which element is normally of high resistance but has a very low resistance under pressure.

Among other objects of the invention is to provide a pressure sensitive switching material or element of the type described which repeatedly and substantially uniformly, under pressure, changes from an insulator of high resistance to a low resistance conductor.

Among still further objects of the invention is to provide a pressure sensitive element of the type described which has transducer properties in that it has a substantial region where the conductance thereof varies directly with the pressure applied as approximately a straight line or predictable function.

Among still further objects of the invention is to provide a pressure sensitive resistance material or element of the type described which has a greater range of change in resistance and is responsive to smaller forces than heretofore possible.

The objects of the invention are attained by coating metallic conducting particles with a deformable, semi-conducting coating material and incorporating the coated particles in a suitable elastomeric matrix. Preferably, the conducting particles are pretreated with a solution containing the deformable, semi-conducting or potential semi-conducting material before being added to the matrix-forming resin composition. The potential semi-conducting material may be of such a nature as to inhibit polymerization of the resin composition and this also may be advantageous in that the polymerization of the resin is inhibited only at the interfacial region between the individual conducting particles (or the coating thereon) and the matrix. Thus, the conventional process of preparing such products is to add the clean conducting metallic particles and a polymerizing catalyst or vulcanizing agent to the monomer (or partially polymerized) elastomeric composition which is to form the matrix, then casting or molding the mix and curing it to form the polymerized or vulcanized product. According to the present invention, the conventional process or composition is modified so as to include a deformable substance which is adsorbed on the particles, which act to facilitate the conduction of electricity between the particles when the matrix is compressed or stretched to bring adjacent particles closer together, and which may also inhibit or alter the curing of the matrix material.

A practical way for carrying out the process is to prepare the deformable semi-conducting material (instead of forming it in situ on the metal particles) and then applying it to the metal particles, as necessary, before mixing with the matrix material, by for example, dissolving in a solvent and applying to the metal particles. The term deformable, semi-conducting material, as used in this specification and claims will be understood to include non-liquid, organic or inorganic semi-conducting materials which are in a condition to coat the metallic particles, either directly or from solution in a solvent and which have resistivities of $10^{-2}$ to $10^{7}$ ohm centimeters.

The metallic conducting particles added can be any of the metallic particles mentioned above with respect to the prior art. It is found, however, that particles having large specific surface areas produce the best results. Raney nickel is a commercially available material or relatively high specific surface area and produces very good results as does the nickel known on the market as carbonyl nickel (precipitated from nickel carbonyl). Where it is desired that a circuit cease operating after a certain time (for example, after 10–45 days), mercury coated nickel particles can be employed. The size of the metallic conducting particles preferably varies from about 0.1 to about 44 microns, or (preferably) pass a 325 mesh screen.

In addition to those metals mentioned in the prior art, metal particles not heretofore useful in the production of such pressure sensitive resistances, can be employed by the present invention. Thus, aluminum particles when coated according to the invention and dispersed in an elastomeric matrix, produce a pressure sensitive conductor in spite of the fact that aluminum is known to form a passive, non-conducting, metal oxide surface almost instantly in the presence of air. Actually, the carbonyl nickel particles which have been coated according to this invention, are also more conductive than the uncoated particles, although the change in conductivity is not as dramatic as with aluminum particles.

The ratio of elastomeric resin to conducting particles can vary from about 100:75 to 100:110 by weight. A very satisfactory product has a ratio of resin to conducting particles as set forth above and metal conducting particles of a size below 3 microns with a surface area of about 0.5 $m^2$/gram or more. However, a greater reproducible switching effect occurs when there is a mixture of larger spherical particles with the smaller particles, e.g., 75 vol. % of particles 0.2–0.5 microns plus 25% of spherical particles of 5–7 microns in diameter.

Silicone elastomers are one preferred matrix material since these products have good insulating and other electrical properties, retain their basic physical properties over a wide range of temperature, are inert and oxidation resistant with respect to the atmosphere, are inert and corrosion resistant with respect to most chemicals, and are water repellant and resist weathering. Among the silicone elastomeric compositions available commercially, the "RTV" (room temperature vulcanizing) type are suitable and preferred because of the ease in carrying out the vulcanization or polymerization or cross-linking. At least two types of such RTV silicone resin compositions are available, one of which is essentially a heat curing silicone in which the curing reaction is promoted by the addition of a peroxide curing agent and one in which the curing is promoted by the addition of metal soap (especially tin and cobalt soaps). Although said two types of compositions produce polymerized or vulcanized elastomers of substantially the same chemical structure (i.e. long chain structures of the general formula

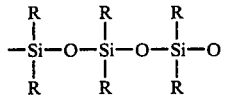

where R is usually a lower alkyl radical, with cross-links between the chains), the soap type of polymerizable composition is usually incompatible with the peroxide type and the catalyst useful for the soap type of composition (i.e., a metal soap) usually acts as an inhibitor to polymerization in the peroxide type of composition and vice versa. According to the present invention, the semi-conducting coating material which is added to the composition, or preferably to the conducting particles in a pretreatment step, may also be an inhibitor to the polymerization of the resin. Silicon compositions which contain fillers such as silica, asbestos, mica, etc., which increase the viscosity of the unpolymerized composition are also useful in this process.

Although silicone compositions are the preferred type of matrix-forming compositions, other flexible or elastomeric-producing, monomeric or flowable intermediate polymeric compositions may be employed as matrix forming materials. Such compositions are widely available commercially and include the natural and synthetic rubbers, polymerizable urethanes, polyakylenes, ethyl vinyl acetate, polyvinylchloride, etc. However, with natural and synthetic rubbers, sulfur should be excluded as the vulcanizing agent.

In addition, polymerizable or resin-forming mixes may be partially polymerized or thickened to a degree just sufficient to form a more or less adhesive liquid composition and mixed with the electrically conducting coated metal particles described herein, to provide a marketable flowable adhesive composition useful for forming electrically conducting coatings on various substrates.

Suitable catalysts for the peroxide type of silicone elastomers include tert-butyl peroxypentalate, 2,4-dichlorobenzol peroxide, caproyl peroxide, lauryl peroxide, p-chlorobenzoyl peroxide, tert-butyl peroxyisobutyrile, acetyl peroxide, benzol peroxide, di-tert-butyl diperphthalate, tert-butyl peracetate, tert-butyl perbenzoate, dicumyl peroxide, 2,5 dimethyl-2,5-di(tert-butyl peroxy) hexane, di-tert-butyl peroxide, methyl ethyl ketone peroxide, p-methane hydroperoxide, cumene hydroperoxide, tert-butyl hydroperoxide, etc. Such catalysts can be used alone or in combination or in solution in a suitable solvent. It appears that a trace of aluminum powder or contact of the metallic particles with an aluminum surface improves the formation of the resistance materials of this invention.

The deformable, coating material for the metal particles can be a material which has semi-conducting properties or one which, by reaction with other material in the mix (the peroxide catalysts, for example), results in a deformable, conducting material and it may include a portion of the elastomeric composition from which the matrix is to be formed. In many of the examples which follow the semiconducting material is the reaction product of a tin or lead soap with a peroxide because that was the way by which the effect was discovered. Suitable metal soaps for this type include include tin laurate, dibutyl tin dilaurate, stannous octoate, cobalt octoate, lead octoate, lead naphthenate and similar nickel, manganese and molybdenum soaps. The reaction of such soaps with the peroxides mentioned in the previous paragraph provides a very desirable semi-conducting material and resembles an inorganic polymer; preferably the reaction is carried out in the presence of an aryl compound if the peroxide itself does not contain an aryl group. As already mentioned above, the process is simplified when the metal soap and peroxide (preferably aryl peroxide) are prereacted to provide a compound which can be later applied to the metal particles. It is believed that some such reaction products comprise a polymer with (—O—Sn—O—Sn—O) bonds (where tin soap is employed) since the reaction products gradually thicken and have filmforming properties. The conductivity of a stannic oxide-aromatics junction has already been described by H. Inokuchi et al (from the text: Symposium on Electrical Conductivity in Organic Solids — Office of the Ordinance Research, Duke Univ., Durham, N.C., Apr. 20,22, 1960. Interscience Publishers, see chapter, "The Photovoltic Behaviors of Aromatic Sydrocarbons"). Also, the many metal complexes which have semiconducting properties are useful in this invention, see "Organic Semi-Conductors" by Okamota and Walter Brenner, New York University, Reinhold Publishing Corp., 1964, pages 66–68. In addition, the non-metallic, complex semi-conductors such as the semi-quinone type molecular complexes disclosed on pages 69–71 of the same references can be employed. In this connection, it is noted that U.S. Pat. No. 3,469,441 discloses a quinone type polymer which per se, acts as a pressure sensitive resistance.

According to the present invention, the amount of the organic conducting material added to the conducting powder can vary from about 5% (based on the weight of the powder) down to about 0.02%.

As already indicated, semi-conducting materials which inhibit curing of a resin, or which comprise components or reaction products which inhibit curing, may be employed and have appeared to enhance the effect desired. Thus, the metal soaps may inhibit curing of the peroxide cured silicone resins at interfacial zones between the metal particles and the resin matrix. In some cases also, water, a polymerization inhibitor, may be added to form a slurry of the metal powder prior to mixing with the resin forming matrix material.

In a preferred form of the invention, the metal conducting particles are coated with the deformable, semi-conducting coating material prior to adding to the elastomeric, matrix-forming, material and the semi-conducting material is a complex type of compound such as one having charge transfer properties or a metallo organic type of complex. The coating appears to form a boundary area or separate phase between the metal particles and the matrix resin. In the cases where the coating layer is an inhibitor of polymerization, it is believed that the inhibited polymerization product is more adherent to the metal particles than the bulk of the polymerized matrix. It has been discovered, however, that the effects in the finished product can be destroyed by severe hammering and this result is attributed to the removal or destruction of the coating. Another explanation of the destruction of the effects by hammering is that the coated particles form agglomorates which are loosely connected even after thorough mixing with the matrix.

The products of the invention show appreciable decrease in resistance when placed under tension, as well as when compressed.

The FIGURE in the drawing is a resistance-pressure curve shown by one of the products.

The invention will be exemplified in the following specific examples with the understanding that these examples are preferential and illustrative and not be considered as limiting the invention to the data given.

EXAMPLE I

Ten grams of silicone resin composition known as RTV-11 (an RTV resin polymerized with the aid of a metal soap and sold by General Electric) was combined with 2 drops of tin octoate and 2 drops of 60% methyl ethyl ketone peroxide dissolved in dibutyl phthalate. As soon as these materials were thoroughly mixed, 8 grams of the slurry of Raney nickel were added and thoroughly mixed. The Raney nickel, which is a very finely divided nickel that is pyrophoric, was made into a slurry with an organic liquid such as an alcohol, replacing water. The 8 g of slurry added was largely nickel, but included the weight of the organic liquid. The mix was doctored into molds to a thickness of 1/16 inch to ½ inch, allowed to set at room temperature for 45 minutes and gradually heated to 105° C., over a period of one hour, and then maintained above 100° C. for 20 minutes. The resultant strip, about 0.200 inches thick, showed a resistance between electrodes, 1/16 inch round probes on opposite sides of the strip, of from 10 meg-ohms under no pressure, down to 1000 ohms under manually applied pressures. Unless otherwise specified, all tests recorded below were made by these same probes and a resistance meter. The repeatability of resistance under a given compressive force was found to be within 5%. When the strip was cut and trimmed, improved results were obtained and the improved results were attributed to the improved configuration of the resistance element between the electrodes.

EXAMPLE IA

When Example I was repeated with butyl alcohol added to the resin as a diluent to increases the loading of conductive particles of the nickel, a strip having lower resistance under pressure was obtained. Some variation in resistance occurs with different degrees of dispersion.

EXAMPLE 2

Two drops of stannous octoate, two drops of dibutyl tin laurate and 0.1 g of benzoyl peroxide were dissolved in 6 g of benzene and the solution mixed with 10 g of silicone resin, GE's RTV 11. After thoroughly mixing with the aid of a spatula, a slurry containing 8 g of nickel powder (a carbonyl nickel powder sold by International Nickel Company and identified as Mond 255) was added and mixed therewith. The Mond 255 nickel has a specific surface of about $0.5m^2/g$. The slurry was made with 4 grams of water, all of the excess water having been pressed out of the cake. The mixture with excess solvent was thickened by evaporation and cast onto an aluminum foil and allowed to remain overnight. The resultant set mixture was baked for 3 hours at 110° C.

In Sections 20 mils thick, the resistance between probes was changed from 500 ohms to 2 ohms under pressure.

EXAMPLE 2A

Example 2 was repeated with 7 grams of water added to the nickel powder to form a wet slurry which exudes a few drops of water when mixed with silicone.

Areas of the material showed switching action between 200 k ohm to 50 ohm under probe pressures. In one section, ¼ inch thick, the material switched from near open circuit under no pressure down to 200 ohms under repeated pressure.

The materials of Example 2 adhered rather well to aluminum.

The above examples were not the best samples prepared according to the invention, but were sufficiently improved over products familiar to inventor to lead the way to further improvements. It will be noted, for example, that although the resin composition RTV 11 of General Electric, employed in Examples 1–2A is a resin which is adapted to be set by a metal soap, these examples included a peroxide catalyst which ordinarily inhibits polymerization of these resins. Examples 2 and 2A also employ an aqueous slurry of the metal particles and water is also known as an inhibitor. The following examples show later developments of the invention.

EXAMPLE 3

80 g of the Mond 255 nickel powder were dry mixed with 2 g of a very finely divided silver powder ( a powder identified as V-9 of duPont), and a slurry of this mixed powder was obtained by adding it to a liquid containing 10 g of benzene, 10 g of tetrachlorethylene, 8 drops of dibutyl tin laurate and 10 drops of tert-butyl peroxybenzoate. Thereafter, 90 g silicone resin composition (RTV-21, a metal soap catalyzed type of composition sold by General Electric) was mixed with the slurry of powder and poured into a pan mold to a thickness of 1/16 inch to ⅛ inch. The cast resin was slowly cured at 90° C. for 4 hours and then at 135° C. overnight. The resultant strip showed switching properties with a resistance, between the two sides, varying between 1 meg-ohm down to 1000 ohm. However, the performance improved after aging 2 months, where resistances varying between 1 and 1.5 meg-ohm down to 3 ohm (under pressure) were obtained.

EXAMPLE 4

90 g of Mond 255 nickel powder was introduced into a solution of 1 g of tin octoate in 20 g of tetrachlorethylene and allowed to stand for several hours at room temperatures. In a separate vessel 90 g of Dow RTV 3120 silicone resin (a tin soap catalyzed type of silicone composition which contains iron oxide filler and has a pasty consistency) was mixed with a solution containing 9 drops of tert-butyl perbenzoate in 20 g of ethyl alcohol and the mixture was degassed (by applying a vacuum, for example). Excess liquid was decanted from the metal slurry and the remaining slurry mixed with the resin, and the mix poured into a pan mold. The mold was heated slowly to 95° C. and maintained at this temperature for a period of one hour whereupon some evaporation and some curing took place. The tacky mixture was allowed to stand at room temperature for twenty-four hours. Final curing was carried out at 150° C. Strips from about 1/32 inch to ⅛ inch thick showed resistances through the thickness varying from 100,000 ohm under no pressure to less than 1 ohm under pressure.

EXAMPLE 5

100 g of nickel powder (Mond 255) was mixed with a solution of 2 g of tin octoate in 20 g of butanol and the mix allowed to stand for several hours. In a separate vessel, 100 g of the silicone resin composition GE RTV 560 (a metal soap catalyzed type of polymerizable resin) was mixed with a solution of 0.5 g of tin laurate and 9 drops of tert-butyl perbenzoate in 20 g of butanol. The resin solution was mixed with the metal slurry, the mix deaerated and cast into two pans, one of which was covered and the other left uncovered. The cure of the mix of the covered pan was inhibited. Both pans were cured as in Example 4. The resultant cured sheets gave a switching action type of product having a resistance between 10,000 ohms at no pressure to about 0.20 ohms under pressure with different pressure sensitivities for the differently formed sheets (better sensitivity in the inhibited sheet).

EXAMPLE 6

In a mix of 1 g tin octoate, 40 g of perchloroethylene and 10 drops of tert-butyl peroxybenzoate, 97 g of carbonyl nickel powder was dispersed and the mix gently heated to about 110° C. in a loosely closed container for about one hour. In a separate vessel, 102 g of the silicone resin composition GE RTV 21 (a metal soap polymerizing composition) and 0.5 g of dibutyl tin laurate were mixed and degassed. After cooling, the nickel powder with the remaining perchloroethylene was mixed with the resin, cast to form a strip and cured 2 hours at 80°. The cured strip was about 1/16 inch thick and functioned exceptionally well as a switching action type of resistance having a resistance of 1 megohm under no pressure down to 10 ohm under manually applied pressure between electrodes of the resistance meter.

EXAMPLE 7

The process of Example 6 was repeated substituting another soap cured silicone resin, namely GE's RTV 560, for the RTV 21 and increasing the Ni:Resin ratio to 1:1. The product obtained had a resistance range from less than 1 ohm to 1 megohm and had a diode effect.

The diode or pressure polarizable effect referred to above was discovered on a 1/16 inch thick material subjected to 10–15 cycles per minute at 12–15 psi and 5 volts with a 1100 ohm limiting resistance in series. Under these conditions, the material showed a gradual decay in conductivity over a period of 5–15 minutes from a resistance in the low range of less than 1 K to over 100 K with the high end remaining over 100 k. Reversing polarity in the specimen between the silver electrodes produced instant return response with the low values below 1 k Ohm. The mechanical strength remained constant. The electrical effect progresses under cycling even when the current is interrupted.

Pressure polarizable products such as disclosed in Example 7 are useful as passive counting materials, flexible electromechanical memory sensors, persistent display and readout devices which are erasable by electrical polarity switching, pacing and recycling aids in teaching machines, low cycle randomizing actuators and such other applications where properties of persistence are uniquely cumulative so that energy input, work expended, time, force and voltage vectors can be recorded. Thus simplified, bio-feedback circuitry and instrumentation devices, which have memory within the sensor element are made possible.

The procedure of Examples 1–7 has been followed to produce products in which the conducting metal is a silver, tin, copper, silver coated nickel, and mercury coated nickel. With the mercury coated nickel, the product showed a range of resistance of 1 ohm to 1 meg, but then, after a period of about 10–45 days, showed a resistance of 1000 ohms under pressure. When carbon is added to any of the above Examples, it apparently absorbs catalyst from the resin and a long period of cure is required.

EXAMPLE 8

The same procedure as in Example 6 has been employed with a foaming type of silicone resin, GE's RTV 7, which was cured with dibutyl tin laurate, the nickel particles being pretreated as in Example 6. The curing of the resin was inhibited by the peroxide coated nickel, but the forming proceeds and after an additional curing for about 2 weeks at room temperature, a ⅜ inch thick, non-sticky tape was obtained which had a trandsducer action in a low range of resistance from 25 ohms at 60 psi to 4 ohms at 105 psi.

EXAMPLE 9

A mixture of 10 g stannous octoate, 3.3 g of butylperoxybenzoate in 10 g of perchloroethylene was allowed to react slowly without gassing and then heated to 95° C. for 30 minutes and allowed to cool. 100 g of Mond 255 nickel was treated with 1.5 g of the resultant mix, the solvent removed and the metal dried.

A second additive was prepared adding 10 g of chloral to 30 g of stannous octoate and then adding 10 g of tertbutylperoxy benzoate. Heat was evolved during these additions. 0.5 g of this second additive was added to the 6.3 g of the polyol portion of a two component polyurethane resin. In such polyurethane compositions, one component is a polyisocyanate and one is a polyol in the mol proportions of approximately 2:1. The resin component employed was the Polycin 879 of Baker Castor Oil Co. 15 g of the nickel mix above was added to the Polycin 879 and then 3.7 of the polyisocyanate, Vorite 689 M-2 (also of Baker Castor Oil Co.), was added. The mix was cast on aluminum foil heated to 90° C. to initiate the cure and then allowed to complete the cure at room temperature for 10 hours. Thereafter, the mix was finally cured at 90° for 30 minutes to provide a flexible film 1/16 inch thick. The film had a resistance of 100 ohm at no pressure to 6 ohms with hand applied pressure between the electrodes.

The following Example discloses the idea of prereacting the metal organic compound with a complex forming reagent such as the aryl peroxides.

EXAMPLE 10

Two grams of tin octoate and one gram of 1,1-di-t-butyl peroxy-3,3,5-trimethylcyclohexane (a peroxy catalyst supplied by Noury Chemical Co.), were diluted with a little trichlorethylene and allowed to heat to about 200° C. After a brisk, smoky reaction, taking about 5 minutes, one gram of the resultant viscous, product was dissolved in dichlorethane, 50g, and mixed thoroughly with 100 grams of Mond Nickel Powder 255, then thoroughly dried by heating to 120° in an oven, and then mixed with an equal amout of GE's RTV #21. To the mixture 0.5 of a catalyst, dibutyl tin dilaurate, was added and the mix cast and cured to form a thin film 1–2 mm thick. The film produced had a resistance varying from 5–10 megohms under no pressure, down to 5–10 ohms under firm pressure.

In the above Example, the reproducability of the resistance under fixed pressure could be increased by replacing the 100 g of Mond Ni with 100 g of a mix containing 75 vol % of Mond nickel and 25 vol % of small nickel spheres of 5–7 microns in diameter.

Similar reaction products of the following metal organic compounds: dibutyl tin hexoate, stannous oleate, manganese octoate, dibutyl tin oxide, dibutyl tin dichloride, tetraphyenyl tin, nickel caprylate, cobalt octoate, germanium tetraethyl and lead octoate; were treated with one or more of the following peroxides: (a) tert-butyl peroxybenzoate (b) 1,1-di-t-butyl peroxy-3,3,5-trimethyl-cyclohexane (Percadox 29-c-75), (c) $\alpha$ $\alpha$-bis (t-butyl peroxy) diisopropyl benzene (Percodox 14); in the ratio of two parts of the metal compound to one part of the peroxide. In all cases, a reaction occurred and a film-forming product was produced which dissolved in trichlorethylene. When such reaction products were applied as a coating to Mond Nickel Powder 255, and the powder was subsequently mixed with a substantially equal weight of silicone resin composition, cast films therefrom showed pressure sensitive resistance properties varying from the order of 10 megohms under no pressure to the order of 1 ohm under pressure.

The following Example discloses that the process is effective with aluminum powder in spite of the fact that aluminum, exposed to air, is known to have a passive oxide coatig thereon.

EXAMPLE 11

A reaction product similar to that of Example 10 was formed between 2 parts of nickel acetoacetonate and one part of 1,1-di-t-butyl-peroxy-3,3,5-trimethylcyclohexane. One part of the reaction product dissolved in acetone was applied to 100 parts of finely divided aluminum powder (Alcan MD 294) and the mix dried at 120° for one hour. The resultant material was sieved and the appearance thereof was practically the same as the original Al powder. Thereafter, 50 grams of the powder were mixed with 50 g of silicone resin composition (#21 RTV of General Electric), 25 g of benzol was added as a thinner and 6 drops of dibutyl tin laurate added as a catalyst. The mix was degassed and cast to the form of a film. The set film was still somewhat bubbly and showed a resistance of the order of 1000 megohms under no pressure, but a resistance of several ohms under pressure.

Absent the coating on the Al powder, it has not been possible to make a pressure sensitive film with any degree of conductivity under pressure, and, in fact, it has been found impossible to take flakes of Al and compress them between electrodes so as to obtain any degree of conductivity.

It is not necessary that the conductive coating material for the metal particles include a radical resulting from reaction with a peroxy compound. The following Examples 12–13 show alternative reaction products.

EXAMPLE 12

1 g of glycerophosphoric acid was dissolved in 50 ml of tetrahydrofuran. The mixture was added to 100 g of finely divided Ni powder (Carbonyl Ni), and the slurry heated to a fairly high temperature of 160° to vaporize the solvent and to provide a residue-covered Ni powder. The coated powder was dispersed in 90 g of silicone resin composition (RTV-11 of General Electric) to which 1 g of manganese octoate catalyst had been added just prior to addig the metal. The mix was cast and cured at 100° C. for three hours, then post cured at 135° C. for one hour.

The product had a resistance under no pressure of 10 megohm and a resistance under manually applied pressure of 20 ohms.

The coating material of Example 12 is especially suitable when the matrix material is to be made from a solution of the silicone resin since this coating is not soluble in hexane or benzene which are the usual solvents used to dilute or dissolve the resin. Some instances of non-uniform results have been traced to a dissolution of the coating by the solvent for the elastomeric matrix material.

EXAMPLE 13

0.9 g of tin poly (cobalticinium esters), (Abstract No. 68 of the Industrial and Engineering Chemistry Division of A.C.S. for the Chicago meeting, August 27–31, 1973, discloses a method of making such esters), was dissolved in 300 ml. of benzene at refluxing temperature. 100 g of finely divided Nickel Powder (Mond 255) was rapidly added to the sealed refluxing solution while stirring and the refluxing continued for four hours at the boiling temperature. The treated metal was filtered and allowed to dry in an inert nitrogen atmosphere. 90 g of a silicone resin composition (RTV-11) to which 0.5 g of dibutyl tin laurate was added, was degassed an then carefully mixed with the treated nickel powder. The mix was cast and allowed to harden at 90° then post cured at 120° overnight. The resulting product had a resistance of 100 K ohms under no pressure and a resistance of 0.1 ohms under manually applied pressure.

The tin poly (cobalticinium ester) of Example 13 is one of a group of metallocene compounds which are film forming, charge transfer type complexes and show semi-conductor properties so as to be suitable for coating the metal conducting powders of the present invention. The theoretical aspect of conductivity in charge transfer complexes is given in the Review of Published Data, published by John Wiley & Sons, Inc., in Organic Semiconductors (Felix Gutmann and Lawrence E. Lyons), 1967, Section 8.4, pp 460–463 (the last complete paragraph on page 462 states that "the resistivity minimum is most pronounced in the strongly interacting complexes, etc.").

As already mentioned, silicone resins are a preferred matrix material although other elastomeric resins may be employed. A portion of the desirable properties obtained with silicone resins may be attributable to the intermediate formation of silyl peroxides which are known to have especially good adhesive properties for metals (see the Article "Adhesion Promotion with Silyl Peroxides", by Gordon M. Kline, pp 107–110 of Modern Plastics for May, 1970). The following Example makes use of this property.

EXAMPLE 14

2 g of nickel acetoacetonate were mixed with 1 g of silicone resin (RTV-11) and 1 g of (75%)l,1-Di-t-butylperoxy-3,3,5-trimethyl cyclohexane, and then heated to about 150° C. to provide a yellow-brown non-crystalline, solid. 0.25 g of the solid was dissolved in 50 ml of dichlormethane, and applied to 100 g of finely divided nickel powder (Mond 255). The resultant coated Nickel Powder was dispersed in 110 g of depolymerized rubber, such as that obtained from Hardman Rubber Co. and sold under the trademark HARDMAN DPR 7419A to which 17 g of lead peroxide curing agent (#517) was also added. On coating and curing a 0.030 inch thick sheet for 4 hrs. a film was obtained which had a resistance of 10 megohms at low pressure and a resistance of 2 ohms at relatively high manually applied pressure.

Another series of non-peroxy organic compounds adapted to coat and to form electric current passing interfaces with metallic particles are the organic orthotitanates, tetrabutyl titanate, tetrakis (2-ethyl hexyl) orthotitanate, etc., or reaction products thereof. The following Example illustrates this type of composition.

EXAMPLE 15

4 g of stannous octoate were mixed with 1 g of tetrabutyl titanate whereupon heat evolved. The reaction mixture was dissolved in 50 ml of dichloromethane and the solution mixed with 100 g of carbonyl nickel powder. The solvent was driven off by heating to 110° C. The cooled, coated metal was mixed with 103 g of the silicone RTV-11 of General Electric which had been catalyzed just previously with 0.5 g of dibutyl tin laurate. The mix was cast and cured overnight at room temperature. The resultant film had an electrical resistance of between 10 megohms under low pressure and 10 ohms under relatively high manually applied pressure.

Conductive or pressure sensitive resistances of an adhesive nature can be made by the process of the invention with matrices of rubber, urethane, silicone and vinyl resins, for example. Such adhesives are useful in forming ground leads (see U.S. Pat. No. 3,762,946, for example), tape circuits, securing terminals, reducing static discharge, shielding layers, security alarm wiring, paste-on circuitry and controls, temporary leads, etc. The following Examples illustrate such an adhesive.

EXAMPLE 16

Mond (255) nickel was treated with 1% of the reaction product of nickel octoate and l,1-di-t-butyl peroxy -3,3,5-trimethylcyclohexane, 55 g of the treated nickel is mixed with 55 g of the adhesive silicone resins composition SR-537 of General Electric. The mix is tacky and highly conductive. This composition can be marketed as a plastic coating composition.

Many of the above Examples disclose a silicone resin as a matrix material since such resins based on their electrical properties, etc. have advantages. Polyvinyl chloride, however, provides a satisfactory product at a relatively reduced price and the following Example illustrates the manufacture of such a product.

EXAMPLE 17

The composition consisted of the following components:

| | |
|---|---|
| 2 parts | Dibutyl tin dilaurate |
| 39 parts | Vinyl chloride resin (GEON 121) |
| 13 parts | Dioctyl phthalate (as plasticizer) |
| 48 parts | Mond 255 nickel powder coated as in Example 14. |

The vinyl resin was blended with the plasticizer to form a powder. The powder was mixed with the coated nickel powder. A cake of the mix was placed between the plates of a hot press at about 168° C. and fused. The product had a resistance of 50 megohms under no pressure and 50 ohms at manually applied pressure.

EXAMPLE 18

The pressure-resistance graph of FIG. 1 of the drawing was made on the following vinyl-resin matrix material. 100 grams of polyvinyl chloride powder (Geon 121), 60 grams of dioctyl phthalate, and 3 grams of dibutyl tin laurate were blended in a high intensity mixer until a uniform pourable vinyl plastisol liquid was obtained which did not separate on standing. In a separate vessel, 40 grams of nickel octoate (6%) and 2 ohms of l,1-di-t-butyl peroxy-3,3,5-trimethyl cyclohexane were mixed, heated to about 210° C. whereupon reaction occurred; the resultant resin-like solid was dissolved in dichloromethane and applied to 30 grams of Mond nickel 255 to form a 1% coating of the reaction product on the metal. 30 grams of the treated nickel was blended with 30 grams of the vinyl plastisol liquid, degassed, and cast in a Teflon-coated pan to produce a flat flexible sheet slightly over 1 mm thick. The pressure resistance diagram of the drawing was obtained fro this material using flat electrodes of 0.200 inch diameter.

Additional experimentation and literature searches have been carried out in an effort to explain the high variation in resistance obtained by this process. These experiments originally fortified my belief in an early hypothesis that the improved results were due to the formation of an incompatible dispersed phase and inhibition of the polymerization of the resin in the region immediately adjacent to the conducting particles. Thus, in Example I, the inhibitor catalyst, a peroxide, is only present in the mix, whereas improved results were obtained according to Examples 3–5 where an inhibiting catalyst is premixed with the conducting particles, and further improved results were obtained according to Example 6 where the premix of conducting particles and inhibitor is preheated. According to Example 6, the premix of metal includes tin octoate as well as the peroxide inhibitor and there is a reaction between the tin octoate and the peroxide. It should be noted in connection with this hypothesis that the directions for setting the peroxide cured "A and B platinum" type silicone resins of GE's RTV-600 series, state that such resins are not compatible with tin soap cured RTV's and further state that all molds, etc., which have been used for the latter RTV compounds, must be thoroughly cleaned with soap and water or solvent, then dried and barrier coated before being used for said RTV-600 series. It is also known that particles of colloidal size, such as the conducting particles of the mix, are ordinarily charged and, in suspensions, attract ions of the opposite charge. Thus, in Example I, where the metal particles are not premixed with the inhibiting type of catalyst, a completely cured body is still obtained, possibly because the inhibitor type of catalyst is attracted to the metal particles. Later experiments, such as Example 9, lead me to believe that the inhibitor effect is less important than previously believed. As stated above, there is evidence that a reaction takes place between the benzoyl peroxide and the tin octoate when mixed with the metal particles in Examples 3–8, so that an inhibitor is not necessarily present on the particles added to the resin. Example 9, for example, shows that such a reaction product can be preprepared and thereafter added to the metal conducting particles.

In the product of the invention, particle to particle contact does not appar to be necessary to product conductivity, and indeed, photomicrographs indicate that particle to particle contact does not always occur, but in practice the coated particles often do come in pressure contact. Thus, particles of relatively low conductivity (see Example 11, for example), coated with a material of relatively low conductivity and embedded in a matrix produce relatively high conductivity on the application of pressure.

One great advantage of this invention is that high conductivities under pressure can be obtained without overloading the elastomeric resin matrix with metal particles. Thus, a product with greater flexibility, greater tensile and compressive strength, and greater durability under repeated pressure cycles is obtained. Also, the product has a lower specific gravity. Thus, the dense (non-springy) silicone matrix type of product of the invention has an sp. gr. of around 2.5 whereas a product heavily loaded with metal particles has a sp. gr. of 3.5–4.0. For some applications, the lower sp. gr. can be important.

The material can be made in a complete range of conductivity from 0.01 ohms under pressure to 100 megohms without pressure, for example. The actual conductivity under pressure does depend on the thickness and hardness of the layer and both of these parameters can be readily varied. The conductance produced can be directional or anisotropic, for example, several spaced pairs of pressurizable conductors applied across the thickness of a sheet of the material act independently, i.e., there is little, if any, lateral conductance or interference produced by the neighboring pairs of conducting probes.

The products of the invention produce greater conductivity under pressure than products with the same proportion of metal inclusions, but without the coatings. Also, although no extensive longevity tests have been run on the products of this invention, it is known that they withstand many thousands of applied pressure cycles without substantial deterioration and it is also known that they hve greater life under use than commercially available products of the same current carrying capacity. There are several possible explanations for the improved results obtained with the products of the invention. It will be realized that most available finely divided metal particles are distinctly angular in shape with sharp corners and edges. Applying an adherent coating to such particles rounds off the corners and edges. The applied coating is not rigid or crystalline and instead, is reversably deformable similar to the elastomer matrix in which the particles are embedded. Although the coating is not as good a conductor as the metal particle itself, the area of contact and number of possible conducting paths is increased considerably when two coated particles come into contact. The result is visualized as similar to that of two balloons being pressed together. This also appears to be similar to the wetting effect noted when a low-conducting liquid is supplied between two conducting bodies which when dry may be brought together, but still do not conduct well because of failure to come into close contact. An additional effect obtaind by the coating is that when pressure is applied to the product through two electrodes and then released, the conductivity is abruptly terminated and any tendency towards arcing between sharp particle edges or points is quenched. That is, electrons or holes are spread over the larger surface of the coating rather than being concentrated at the points or edges. It is believed that the short life of some pressure sensitive elastomers containing metallic particles with sharp or angular points or edges can be attributed to microarcing occurring when conducting particles are separated upon relesing the pressure which keeps them in contact. This microarcing results in oxidation and erosion at the arcing points or edges. When not under pressure, the semiconducting coating of the present invention acts as an effective insulator.

An analogous situation has been found in U.S. Pat. No. 3,709,835 of Forster. According to that patent, it was found that the performance of high voltage conductors could be improved by incorporating semi-conducting materials in the insulating coating of the conductors. Column 2, lines 41–47 of said patent read as follows:

"Under low voltage stresses, the semi-conductors act as insulators and conduct no electricity. As the voltage increases to the order of 1.0–100 kilovolts, the semi-conductors begin to conduct electricity, the conductance being a function of the stress applied and increasing as the applied stress increases."

Although high voltages are not employed with the pressure sensitive products of this invention, the distances are much closer so that lower voltage differences have the effect of producing a proportionately large dielectric field stress, which results in a conducting or insulating phenomenon similar to that observed by Forster at high voltages.

Also, the coated conducting particles of the invention have a lubricity not possessed by uncoated particles so that said coated particles are more mobile within the elastomer matrix and when moved by pressure being applied to the product, the coated particles do no injure the internal structure of the elastomer.

The metallic conducting particles of the present invention can not be compared to the extremely fine carbonparticles which are conventionally added to elastomers as the conductive particles. The following table compares the essential properties of typical particles:

| | Surface Area M2/g | Sp. Gravity | Particle Shape | Resistance Microoohms/ cm | Particle Size |
|---|---|---|---|---|---|
| Conductive Carbon Black | 70. | 1.95 | Chain to dendritic | 1375.0 | Microns 1/70 |
| Carbonyl Ni ("Nickel 255) of "Inco" | 0.68 | 8.9 | Chain and/or Spherical | 6.84 | Microns 2.2 |

Although the metal particles tend to make up for their lower surface area and higher specific gravity (lower vol. %) by their lower resistance, these two types of particles are not really comparable. As already mentioned, the metallic particles, as conventionally added to elastomeric materials for the production of pressure sensitive resistances (except for those coated with noble metals), have oxide coating which increased their resistance, this increase in resistance due to the oxide layer, is overcome by the present invention.

The dendritic chains of the extremely fine carbon particles which form the conducting path in carbon filled elastomers are much more fragile than the conduction paths formed by the semi-conductor-metal particles of the present invention. The resistance-pressure curves obtained with the metal loaded products of the present invention are substantially the same after many testing cycles, whereas corresponding curves for carbon loaded elastomers change when repeated a number of times. With carbon black, it is not possible to obtain the low values of resistance obtainable with metal, because of its resistance, low specific gravity and the fact that the particles are not physically compactable to produce the lower resistances. With carbon also, there is a higher heating effect resultig from the higher resistivity of the carbon.

Another unusual property of the products of the invention is that, as resistances, they have a positive temperature coefficient. Most resistances have negative temperature coefficients. Carbon, for example, is known for its negative temperature coefficient, and similarly carbon loaded pressure sensitive resistances decrease in resistance as the temperature increases. The materials, therefore, have potential utility as compensating means for resistances with negative temperature coefficients.

I claim:

1. As an article of manufacture, finely divided metallic particles, each having a coating of deformable, electrically semi-conducting compound thereon.

2. The finely divided metal particles as claimed in claim 1 wherein the deformable, electrically semi-conducting compound comprises a reaction product of peroxy compound with a metal-organic compound.

3. The finely divided metal particles as claimed in claim 1 wherein the deformable, electrically semi-conducting compound comprises the reaction product of a metal soap and a peroxy compound.

4. The finely divided metal particles as claimed in claim 1 wherein the metal particles comprise nickel and the deformable, electrically semi-conducting compound comprises the reaction product of tin octoate and a peroxy compound.

5. The finely divided metal particles as claimed in claim 1 wherein the deformable, electrically semi-conducting compound is a metal organic polymer.

6. The finely divided metal particles as claimed in claim 1 wherein the deformable, electrically semi-conducting compound is glycerophosphoric acid.

7. The finely divided metal particles as claimed in claim 1 wherein the deformable, electrically semi-conducting compound comprises a semi-conducting non-metallic organic compound.

* * * * *